US007674157B2

(12) United States Patent
Shirao

(10) Patent No.: US 7,674,157 B2
(45) Date of Patent: Mar. 9, 2010

(54) TWO-SIDED SURFACE GRINDING METHOD

(75) Inventor: Yasuo Shirao, Yao (JP)

(73) Assignee: Koyo Machine Industries Co., Ltd., Osaka (JP)

( * ) Notice: Subject to any disclaimer, the term of this patent is extended or adjusted under 35 U.S.C. 154(b) by 0 days.

(21) Appl. No.: 12/077,507

(22) Filed: Mar. 19, 2008

(65) Prior Publication Data

US 2008/0233843 A1 Sep. 25, 2008

(30) Foreign Application Priority Data

Mar. 23, 2007 (JP) ..... 2007-076632

(51) Int. Cl.
*B24B 1/00* (2006.01)
*B24B 7/02* (2006.01)

(52) U.S. Cl. ..... 451/57; 451/63; 451/264; 451/265

(58) Field of Classification Search ..... 451/57, 451/63, 262, 263, 264, 265, 266, 267, 268, 451/269

See application file for complete search history.

(56) References Cited

U.S. PATENT DOCUMENTS 3,859,756 A * 1/1975 Zerbola ..... 451/49
5,121,572 A * 6/1992 Hilscher ..... 451/269
5,934,983 A * 8/1999 Wada et al. ..... 451/63
6,485,357 B1 * 11/2002 Divine ..... 451/58

FOREIGN PATENT DOCUMENTS

JP 2002-307272 10/2002

* cited by examiner

*Primary Examiner*—Timothy V Eley
(74) *Attorney, Agent, or Firm*—Jordan and Hamburg LLP

(57) ABSTRACT

In effecting two-sided surface grinding for surface-grinding the opposite surfaces of a workpiece simultaneously by a pair of oppositely disposed grinding wheels, infeed grinding is performed by oscillating the workpiece within the range where the surfaces to be ground of the workpiece do not protrude from the inner and outer peripheries of the grinding wheel surfaces of the grinding wheels, and then through-grinding is performed by feeding the workpiece to allow the surfaces to be ground to pass along the inner and outer peripheries of the grinding wheel surfaces. As an effect, worn wheel edges or the like can be prevented from being formed in the inner and outer peripheral edges, that grinding wheel surfaces can be maintained in proper shape for a prolonged time, that the grinding accuracy is better, and that dress interval can be prolonged, thus improving the life of grinding wheels.

4 Claims, 6 Drawing Sheets

RELATED ART (B)

TWO-SIDED SURFACE GRINDING METHOD

BACKGROUND OF THE INVENTION

The present invention relates to a two-sided surface grinding method and apparatus for grinding the opposite surfaces of a workpiece simultaneously by a pair of oppositely disposed, rotating, grinding wheels.

As for two-sided surface grinding for simultaneously grinding the opposite surfaces of a workpiece by a pair of grinding wheels, there are an ordinary infeed grinding method and through-grinding method and besides these, there is a grinding method which is a combination of the infeed grinding method and through-grinding method (Patent Document 1: Japanese Utility Model Laid-Open 2002-307272). This grinding method performs infeed grinding by cuttingly infeeding the grinding wheels while oscillating a workpiece by reciprocating a carrier at the infeed grinding position, and then once removing the workpiece from between the grinding wheels by rotating the carrier. And through-grinding is performed by feeding the workpiece into between the grinding wheels by the feed operation of the carrier.

Conventional grinding methods are such that in infeed-grinding a workpiece while oscillating the workpiece by reciprocating the carrier at the infeed grinding position, of a plurality of workpieces circumferentially held by the carrier, two on opposite sides stick out from the outer peripheral edges of the grinding wheel surfaces of the grinding wheels. This results in a decrease in the area of contact of the grinding wheels with the workpieces, and the grinding wheel surfaces are worn to form worn wheel edges in the outer edge because of the cutting operation of the grinding wheels, etc., thereby aggravating the parallelism and flatness of the grinding wheel surfaces of the grinding wheels and decreasing the grinding accuracy. Therefore, it is necessary to correct the parallelism and flatness in a relatively short time, and there is a disadvantage that the dress interval is shortened.

And surface grinding is generally performed as shown in FIG. 11(A), wherein a workpiece 3 held in a pocket 2 in a carrier 1 is fed to pass along the inner and outer peripheral edges of the grinding wheel surfaces 4*a* of a pair of grinding wheels 4. In this case also, part of the workpiece 3 sticks out from the grinding wheel surfaces 4*a* of the grinding wheels 4, leading to a disadvantage that worn wheel edges 4*b* and 4*c* are formed in the inner and outer corners of the grinding wheel surfaces 4*a* as by the cutting operation of the grinding wheels 4, etc. as shown in FIG. 11(B). Particularly, in the case where the workpiece 3 which has a short cycle time and a large grinding allowance is ground, the worn wheel edges 4*b* and 4*c* in the inner and outer corners of the grinding wheel surfaces 4*a* become greater.

In view of such conventional problems, an object of the present invention is to provide a two-sided surface grinding method and apparatus which are capable of preventing worn wheel edges or the like in the inner and outer corners of the grinding wheel surfaces of grinding wheels, capable of maintaining the grinding wheel surfaces in proper shape for a prolonged time, and capable of prolonging the dress interval with satisfactory grinding accuracy ensured, the life of the grinding wheels being improved.

SUMMARY OF THE INVENTION

The two-sided surface grinding method according to the invention is used for surface-grinding the opposite surfaces simultaneously by a pair of oppositely disposed, rotating, grinding wheels, wherein infeed grinding is performed by oscillating said workpiece within the range where the surfaces to be ground of said workpiece do not stick out from the inner and outer peripheries of the grinding wheel surfaces of said grinding wheels, and then through-grinding is performed by feeding said workpiece to allow said surfaces to be ground to pass along the inner and outer peripheries of said grinding wheel surfaces.

At least one of said two grinding wheels may be cuttingly driven at a predetermined cutting speed while oscillating the workpiece at an infeed grinding position, and then said through-grinding may be performed by effecting sparkout at the forward end of travel of said grinding wheel. Further, said infeed grinding may be performed at the infeed grinding position opposite to the discharge side with respect to the center of said grinding wheel, and then said workpiece may be fed from said infeed grinding position to said discharge side. During said through-grinding, the surfaces to be ground of said workpiece may pass along the diametrically opposite inner peripheries of said grinding wheels.

The invention provides a two-sided surface grinding apparatus including a pair of oppositely disposed, rotating grinding wheels, and a carrier for holding a workpiece in a pocket, wherein the opposite surfaces of said workpiece held by said carrier are surface-ground simultaneously by said pair of grinding wheels, said two-sided surface grinding apparatus including an infeed grinding function for performing infeed grinding by oscillating said workpiece within the range where the surfaces to be ground of said workpiece do not stick out from the inner and outer peripheries of said grinding wheels, and a through-grinding function for performing through-grinding by feeding said workpiece subsequent to said infeed grinding, so as to allow said surfaces to be ground to pass along said inner and outer peripheries.

Said carrier may be made as a rotational type, with the pocket of said carrier holding said workpiece such that when there is a difference in the dimension in the rotational direction between the surfaces to be ground of the longitudinal opposite sides of said workpiece, said surface to be ground having a greater dimension is on the rotational center side, while said surface to be ground having a smaller dimension is on the side remote from the rotational center.

Said carrier may be made as a rotational type, with the pocket of said carrier holding said workpiece such that when there is a difference in the dimension in the rotational direction between the surfaces to be ground of the longitudinal opposite sides of said workpiece, said surface to be ground having a smaller dimension is on the rotational center side, while said surface to be ground having a greater dimension is on the side remote from the rotational center.

According to the invention, it is possible to prevent worn wheel edges or the like in the inner and outer corners of the grinding wheel surfaces of grinding wheels, and to maintain the grinding wheel surfaces in proper shape for a prolonged time. Therefore, grinding accuracy improves, and it is also possible to prolong the dress interval. Furthermore, there is an advantage that the life of the grinding wheels improves.

DETAILED DESCRIPTION OF THE INVENTION

Figure 1:
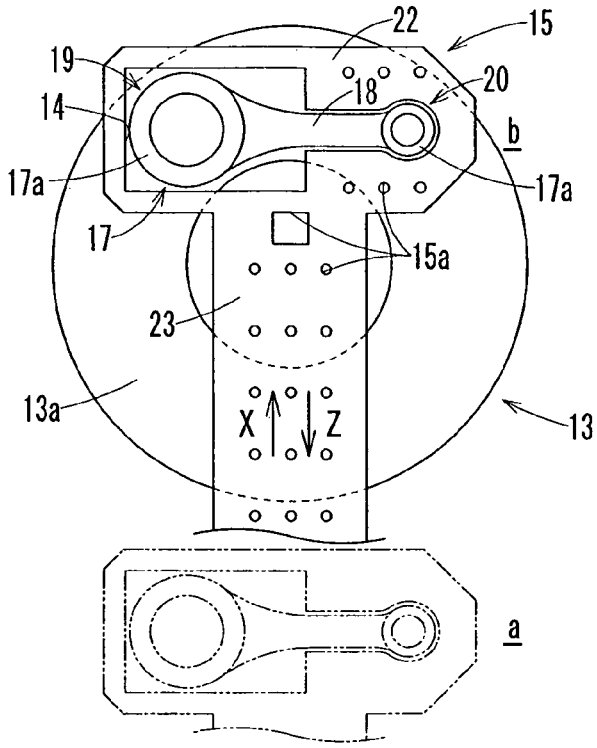
FIG. 1 is a plan view of a vertical, two-sided surface grinding machine, showing a first embodiment of the invention.
Figure 2:
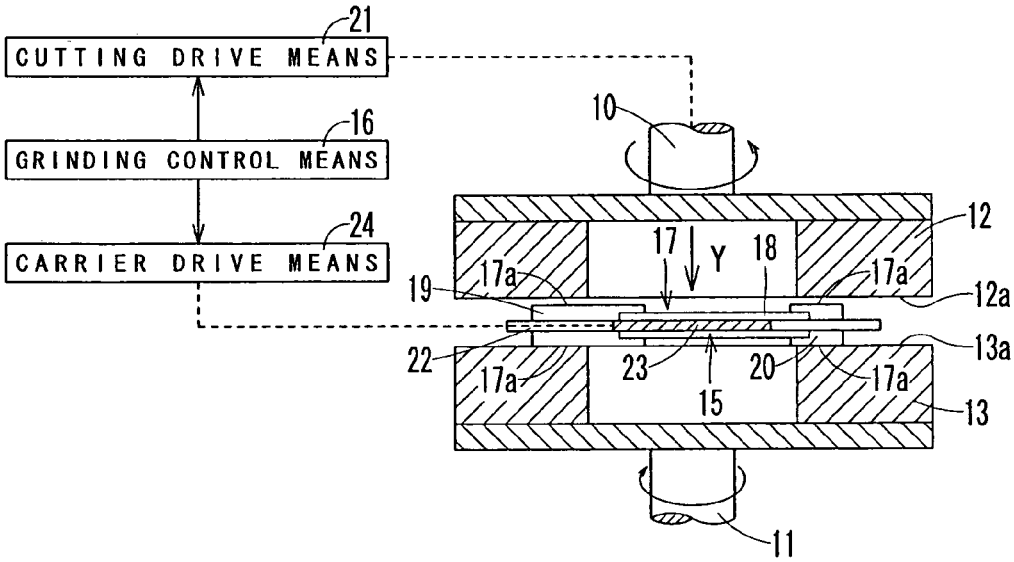
FIG. 2 is a longitudinal sectional view of the vertical, two-sided surface grinding machine.

Embodiments of the invention will now be described in detail with reference to the drawings. FIGS. 1-6 show by way of example a first embodiment of the invention. FIGS. 1 and 2 show a vertical, two-sided surface grinding apparatus. This vertical, two-sided surface grinding apparatus includes a pair of grinding wheels 12 and 13 vertically oppositely disposed and rotating around grinding wheel shafts 10 and 11, and a carrier 15 for inserting a workpiece 17 held in a pocket 14 into between the grinding wheels 12 and 13.

And this vertical, two-sided surface grinding apparatus has an infeed grinding function for performing infeed grinding such that a workpiece 17 is oscillated within the range where the opposite surfaces to be ground of the workpiece 17 do not stick out from the inner and outer peripheries of the grinding wheel surfaces 12*a* and 13*a* of grinding wheels 12 and 13, and a through-grinding function for performing through-grinding such that subsequent to said infeed grinding, the workpiece 17 is fed to allow the surfaces to be ground 17*a* to pass along the inner and outer peripheries of the grinding wheel surfaces 12*a* and 13*a*, said functions being under the control of a grinding control means 16, the arrangement being such that the grinding wheel surfaces to be ground 17*a* of the opposite sides of the workpiece 17 are simultaneously surface-ground.

The workpiece 17 is, for example, a connecting rod (hereinafter referred to as conrod) for automobile engines, and a rod section 18 is provided at the longitudinal opposite ends thereof with a large end 19 and a small end 20 for shaft insertion, it being arranged that the opposite surfaces of each of the ends 19 and 20 be surface-ground. In addition, the workpiece 17 may be other than a conrod.

The grinding wheels 12 and 13 are of a cup type with their inner and outer peripheries formed substantially concentric and are mounted in opposed relation to each other on vertically coaxially disposed grinding wheel shafts 10 and 11, their opposed grinding wheel surfaces 12*a* and 13*a* being parallel to each other. The grinding wheel shafts 10 and 11 are driven for rotation by grinding wheel shaft rotation driving means (not shown) such as motors and can be vertically advanced or retracted by a grinding wheel shaft feed driving means (not shown). Further, at least one of the grinding wheel shafts 10 and 11, for example, the upper grinding wheel shaft 10, can be cuttingly fed by a cutting drive means 21.

The carrier 15 is used for inserting and removing the workpiece 17 into and from between the grinding wheels 12 and 13 and is made of a metal sheet, reinforcing fiber containing synthetic resin sheet or the like whose thickness is less than the clearance formed during grinding between the grinding wheel surfaces 12*a* and 13*a* of the grinding wheels 12 and 13. The carrier is formed in T-shape having a holding section 22 at the front end and a support section 23 extending substantially from the middle of said holding section 22 to the base side, said holding section 22 being throughgoingly formed with a pocket 14 for holding the workpiece 17.

The pocket 17 is adapted to hold the removably fittable workpiece 17 at its large end 19 and small end 20. Further, the carrier 15 is dispersively formed with a number of through holes 15*a* to improve the flow of grinding liquid to the grinding wheel surfaces 12*a* and 13*a* of the grinding wheels 12 and 13.

The carrier 15 is disposed to extend substantially through the middle between the grinding wheels 12 and 13 and is reciprocable by a carrier drive means 24 connected to the base side thereof so as to assume a work take-out position a laterally of and in the vicinity of the grinding wheels 12 and 13, and an infeed grinding position b on the side opposite to the work take-out position a which is on discharge side for the workpiece 17 with respect to the center of the grinding wheels 12 and 13.

Figure 3:
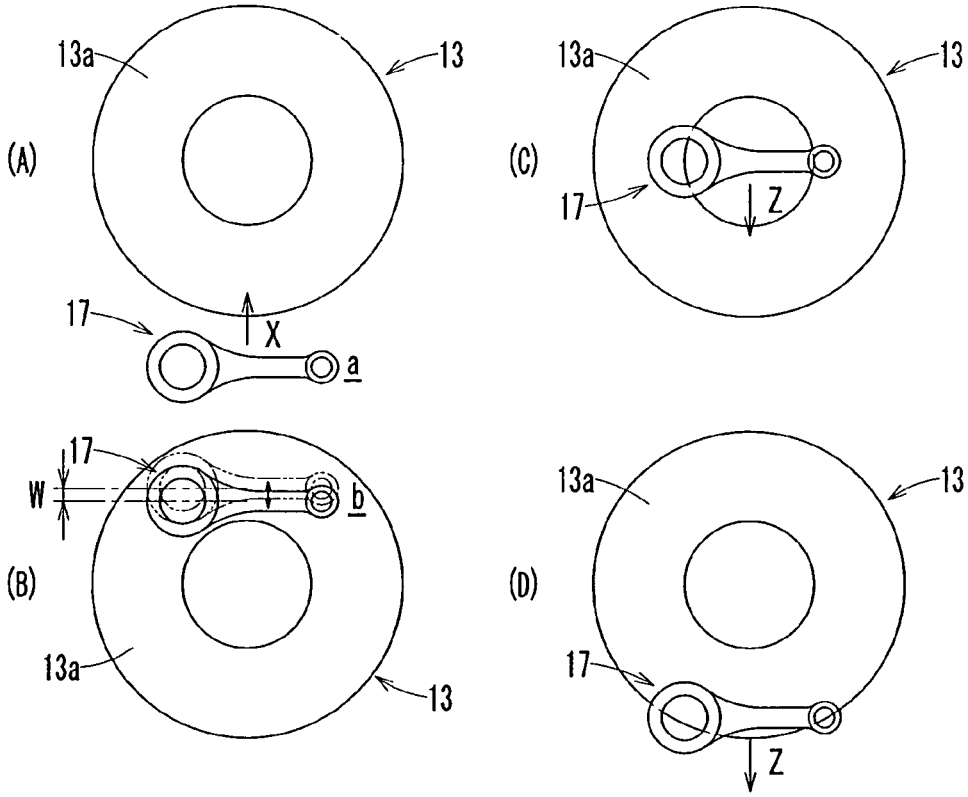
FIG. 3(A)-(D) are explanatory views, showing the position of a workpiece under grinding operation.

The carrier drive means 24, besides moving the carrier 15 between the work take-out position a and the infeed grinding position b, oscillates the workpiece 17 during the infeed grinding of the workpiece 17 at the infeed grinding position b with an oscillation width W within the range where the surfaces to be ground 17*a* of the workpiece 17 do not stick out from the inner and outer peripheries of the grinding wheel surfaces 12*a* and 13*a* of said grinding wheels (see FIG. 3).

The grinding wheels 12 and 13 and the workpiece 17 are so dimensioned that the opposite surfaces to be ground 17*a* of the large end 19 and small end 20 of the workpiece 17 pass along the diametrically opposite inner peripheries of the grinding wheel surfaces 17*a* during the through-grinding. In addition, it is only necessary that the opposite surfaces to be ground 17*a* of the large end 19 or small end 20 of the workpiece 17 pass along the inner peripheries of the grinding wheel surfaces 12*a* and 13*a* of the grinding wheels 12 and 13.

The grinding control means 16 is composed of a microcomputer or the like and is adapted to effect centralized control of each part of the vertical, two-sided surface grinding apparatus according to a program. It is arranged, for example, that rotation control of the grinding wheel shafts 10 and 11 be effected and besides, control of advance and retraction including control of advance, grinding feed, stoppage, retraction of the grinding wheel shafts 10 and 11, oscillation of the carrier 15, etc. be automatically effected.

Figure 4:
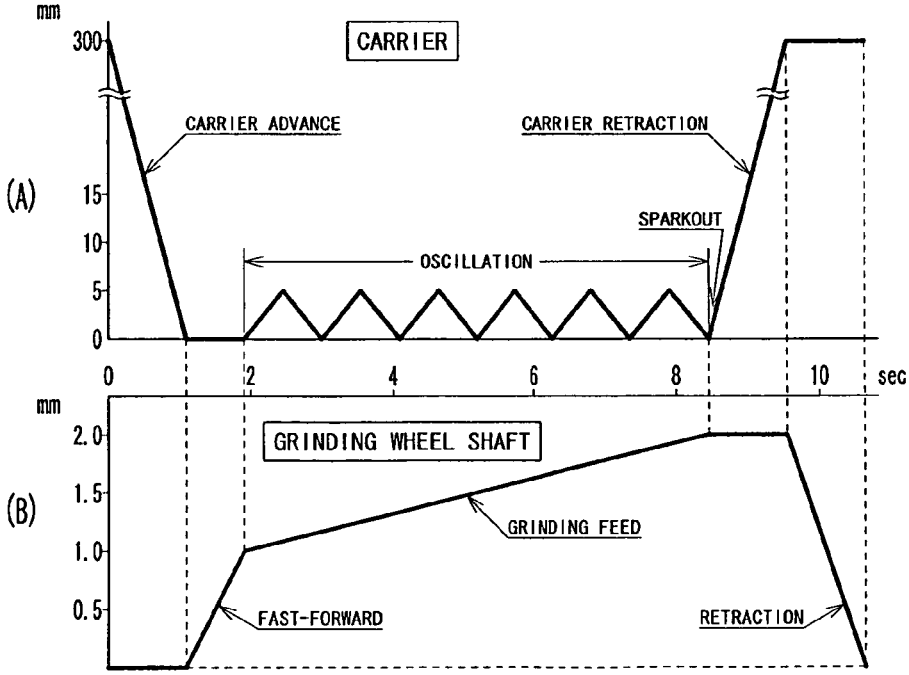
FIGS. 4(A) and (B) are explanatory views, showing the relation between the movement of a carrier and the movement of grinding wheel shafts.
Figure 5:
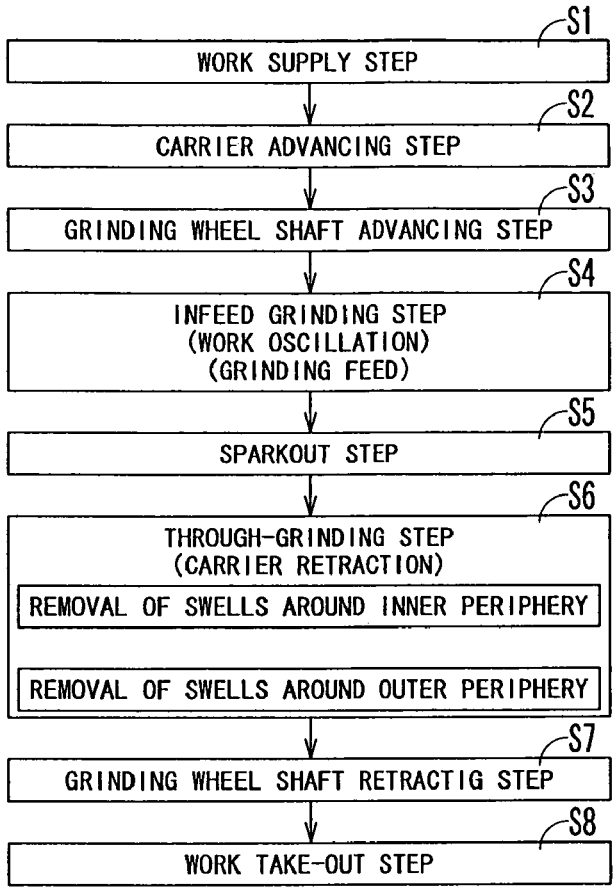
FIG. 5 is a block diagram showing grinding steps.
Figure 6:
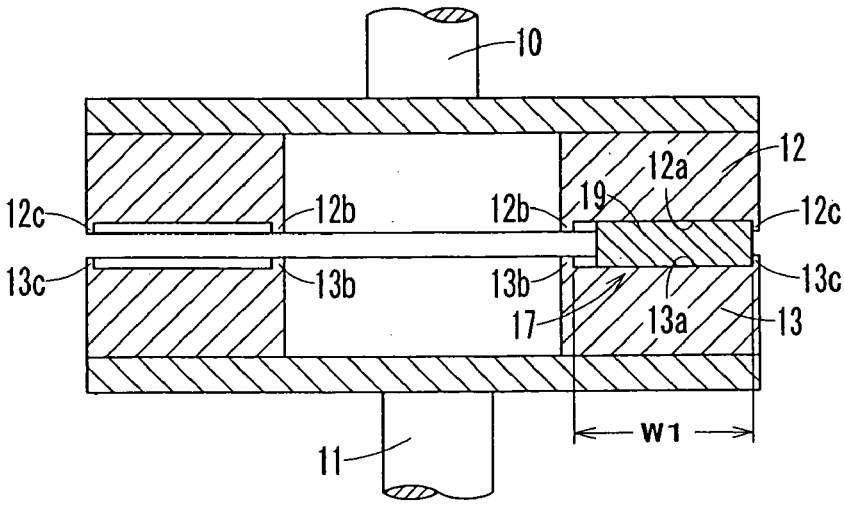
FIG. 6 is an explanatory view showing a grinding state.

A two-sided surface grinding method for grinding the workpiece 17 by using the vertical, two-sided surface grinding apparatus will be described with reference to FIGS. 3-7. FIGS. 3(A)-(D) show the positional relation between the grinding wheels 12 and 13 and the workpiece 17 during the grinding operation. FIGS. 4(A) and (B) show the relation between the movement of the carrier 15 and the movement of the grinding wheel shaft 10 during the grinding operation. Further, FIG. 5 shows each step of the grinding operation, and FIG. 6 shows the grinding state.

First, as shown in FIG. 3(A), the workpiece 17 is supplied at the work supply and take-out position a to the pocket 14 of the carrier 15 (work supply step S1). Next, the carrier 15 is advanced in the direction of arrow X by the carrier drive means 24 to be inserted between the grinding wheels 12 and 13, this feed movement of the carrier 15 carrying the workpiece 17 to the infeed grinding position b shown in FIG. 3 (carrier advancing step S2). On the other hand, the grinding wheel shaft 10 is advanced (downward) in the direction of arrow Y in FIG. 2 by fast-forward until the grinding wheels 12 and 13 reach the start position for infeed grinding (grinding wheel shaft advancing step S3).

And when the grinding wheels 12 and 13 reach the start position for infeed grinding, the carrier drive means 24 reciprocates the carrier 15, the feed movement of the carrier 15 oscillating the workpiece 17, and the cutting drive means 21 grindingly feeds the grinding wheel shaft 10 at a predetermined speed so as to effect infeed grinding (rough grinding) (infeed grinding step S4).

At this infeed grinding step S4, the opposite surfaces to be ground 17*a* of the workpiece 17, as shown in FIG. 3(B), do not stick out to the inner and outer peripheries of the grinding wheel surfaces 12*a* and 13*a* of the grinding wheels 12 and 13, but the workpiece 17 is oscillated with a predetermined oscillation width W shown by the slide line position and the two-dot chain line position so as to provide some margin to the inner and outer peripheries.

This prevents worn wheel edges in the inner and outer peripheries of the grinding wheel surfaces 12*a* and 13*a*, a phenomena which has conventionally occurred in the case where the surfaces to be ground 17*a* of the workpiece 17 stick out from the grinding wheel surfaces 12*a* and 13*a*. In addition, the oscillation of the workpiece 17 is effected a plurality of times until the grinding wheel 12 reaches the forward end through the grinding feed.

When the grinding wheel 12 reaches the forward end, at said forward end is effected sparkout for stopping the grinding feed of the grinding wheel shaft 10 (sparkout step S5), whereupon the carrier drive means 24 retracts the carrier 15 at a predetermined speed in the direction of arrow Z; thus, this retraction movement of the carrier 15 causes the workpiece 17 to pass between the grinding wheels 12 and 13, thereby effecting through-grinding (finish grinding) (through-grinding step S6).

In the case where the workpiece 17 is oscillated so as to prevent the surfaces to be ground 17*a* of the workpiece 17 from sticking out from the grinding wheel surfaces 12*a* and 13*a* of the grinding wheels 12 and 13 during the infeed grinding at the infeed grinding step S4, swells 12*b*, 13*b*, 12*c*, and 13*c*, as shown in FIG. 6, are formed around the inner and outer peripheries of the grinding wheel surfaces 12*a* and 13*a* on opposite sides of the oscillation region W1.

However, these swells 12*b*, 13*b*, 12*c*, and 13*c* can be removed during the through-grinding as shown in FIGS. 3(C) and (D) in that the surfaces to be ground 17*a* of the ends 19 and 20 of the workpiece 17 pass along the inner and outer peripheries of the grinding wheel surfaces 12*a* and 13*a* of the grinding wheels 12 and 13.

That is, as shown in FIG. 3(C), the swells 12*b* and 13*b* around the inner peripheries can be removed when the surfaces to be ground 17*a* of the workpiece 17 pass along the inner peripheries of the grinding wheel surfaces 12*a* and 13*a*, and as shown FIG. 3(D), the swells 12*c* and 13*c* around the outer peripheries can be removed when the surfaces to be ground 17*a* of the workpiece 17 pass along the outer peripheries of the grinding wheel surfaces 12*a* and 13*a*.

And the workpiece 17 is discharged from the grinding wheel surfaces 12*a* and 13*a* of the grinding wheels 12 and 13, completing the through-grinding, whereupon the grinding wheel shaft 10 is retracted from the forward end to a predetermined position (grinding wheel shaft retracting step S7), while the carrier 15 is stopped at the work take-out position a to take out the ground workpiece 17 from the pocket 14 in the carrier 15 (work take-out step S8). This completes the grinding of the workpiece 17. Thereafter, the steps S1 through S8 are repeated to successively grind such workpieces 17.

Adopting such grinding method ensures that worn wheel edges are prevented from being formed in the grinding wheel surfaces 12*a* and 13*a* during the infeed grinding of the workpiece 17 and that the swells 12*b*, 13*b*, 12*c*, and 13*c* formed during the infeed grinding around the inner and outer peripheries of the grinding wheel surfaces 12*a* and 13*a* can be removed during the through-grinding of the workpiece 17; therefore, irrespective of the length of the cycle time or the amount of the grinding allowance, the grinding wheel surfaces 12*a* and 13*a* of the grinding wheels 12 and 13 can be maintained in proper shape for a prolonged time, and the grinding accuracy is improved. Furthermore, since the grinding wheel surfaces 12*a* and 13*a* of the grinding wheels 12 and 13 can be maintained in proper shape for a prolonged time, the dress interval is improved and a resultant advantage is that the life of the grinding wheels 12 and 13 is improved.

Figure 7:
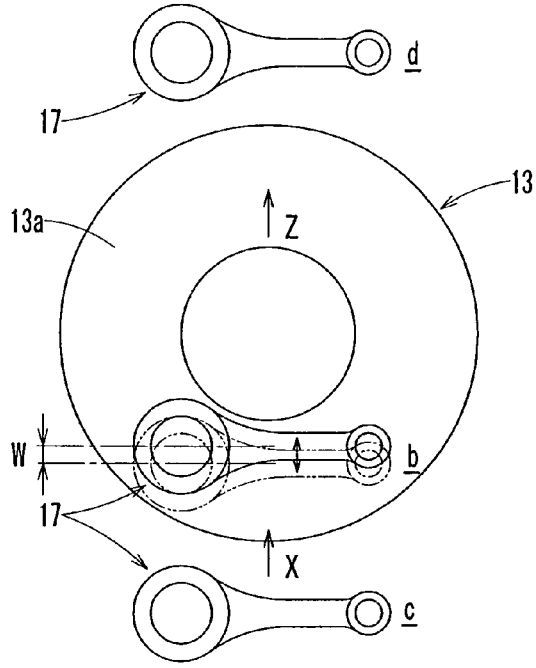
FIG. 7 is a plan view of a vertical, two-sided surface grinding machine, showing a second embodiment of the invention.

FIG. 7 shows by way of example a second embodiment of the invention. This embodiment adopts a linear carrier type in which the work supply position c and the work take-out position d are separated longitudinally of the grinding wheels 12 and 13 so that the carrier 15 linearly reciprocates between the two positions c and d.

In this case, the side opposite to the work take-out position d, which is the discharge side for the workpiece 17, that is, the side nearer to the work supply position c is the infeed grinding position b. With such arrangement, interference between the supply device and the take-out device for the workpiece 17, etc. can be easily prevented.

Figure 8:
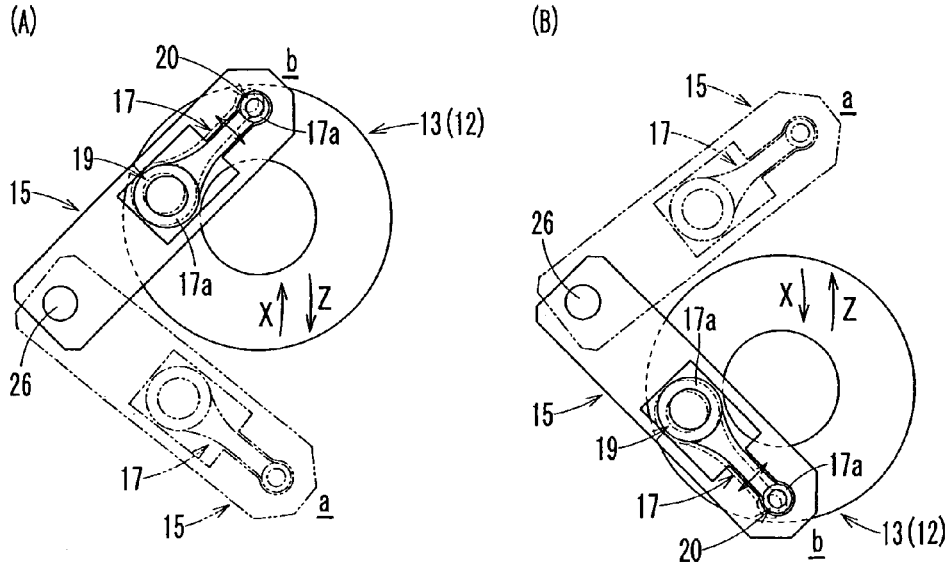
FIGS. 8(A) and (B) are plan views of a vertical, two-sided grinding machine, showing a third embodiment of the invention.

FIGS. 8(A) and (B) show by way of example a third embodiment of the invention. This embodiment adopts a rotational carrier type in which the carrier 15 is supported for rotation around a rotational shaft 26 parallel to the grinding wheel shafts 10 and 11 so that the carrier 15 rotates between the work take-out position a and the infeed grinding position b.

In FIG. 8(A), the front sides of the grinding wheels 12 and 13 are the work supply and take-out position a, while in FIG. 8(B), the rear sides of the grinding wheels 12 and 13 are the work supply and take-out position a.

In these cases, the carrier 15 has only to be supported by the rotational shaft 26, providing an advantage that the structure, etc. are simplified.

The pocket 14 in the carrier 15 is shaped to hole the workpiece 17 such that the large end 19 side of the workpiece 17 is the rotational center nearer to the rotational shaft 26 and that the small end 20 side is the side remote from the rotational shaft 26.

Figure 9:
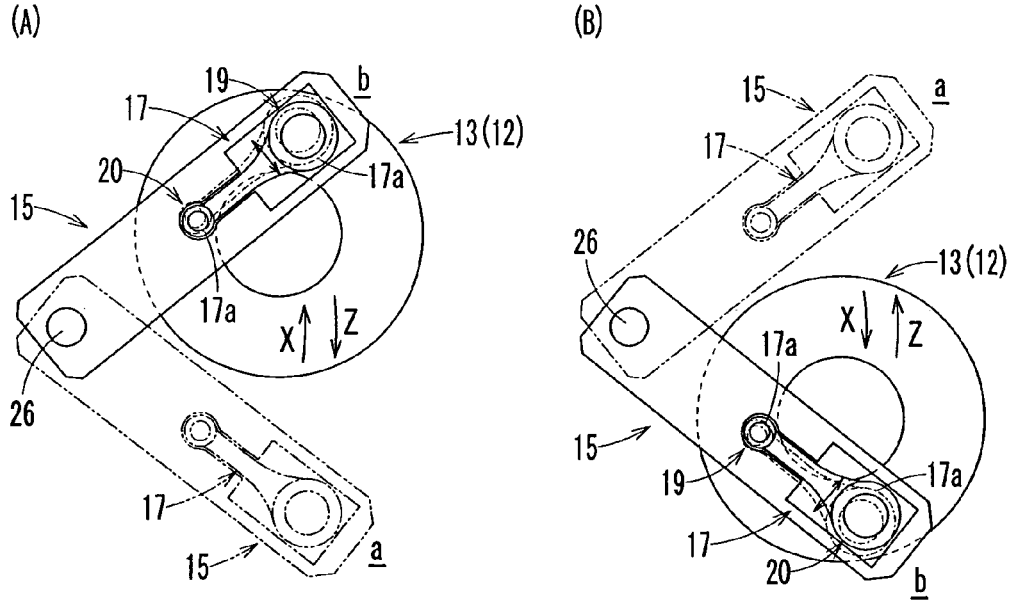
FIGS. 9(A) and (B) are plan views of a vertical, two-sided grinding machine, showing a fourth embodiment of the invention.

FIGS. 9(A) and (B) show by way of example a fourth embodiment of the invention. In this embodiment, the carrier 15 is of the rotational type, while the form for holding the workpiece 17 by the pocket 14 is the reverse of the third embodiment. In this manner, the pocket 14 in the carrier 15 may be adapted to hold the workpiece 17 such that the smaller surfaces to be ground 17*a* are on the rotational shaft 26 side while the larger surfaces to be ground 17*a* are on the side remote from the rotational shaft 26. The rest of the arrangement is the same as in the third embodiment.

In the case where the subject is the workpiece 17 having differences in rotation-wise size between the longitudinal opposite large end 19 and small end 20, such as a conrod, which of the third or fourth embodiment should be employed is a matter of selection with consideration given to the construction, etc. of the supply device. In other words, the direction of the workpiece 17 can be freely determined with consideration given to the construction, etc. of the supply device.

Figure 10:
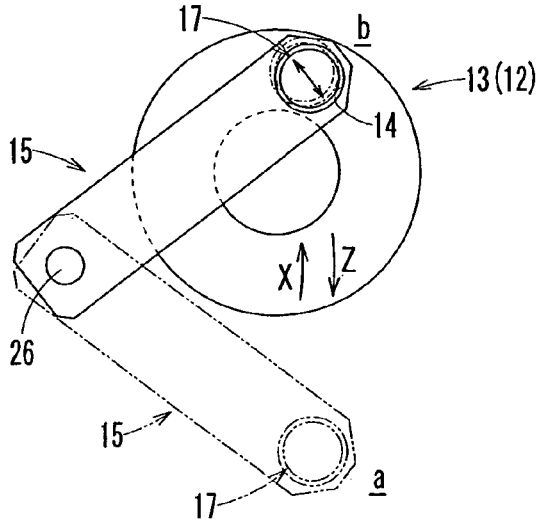
FIG. 10 is a plan view of a vertical, two-sided surface grinding machine, showing a fifth embodiment of the invention.
Figure 11:
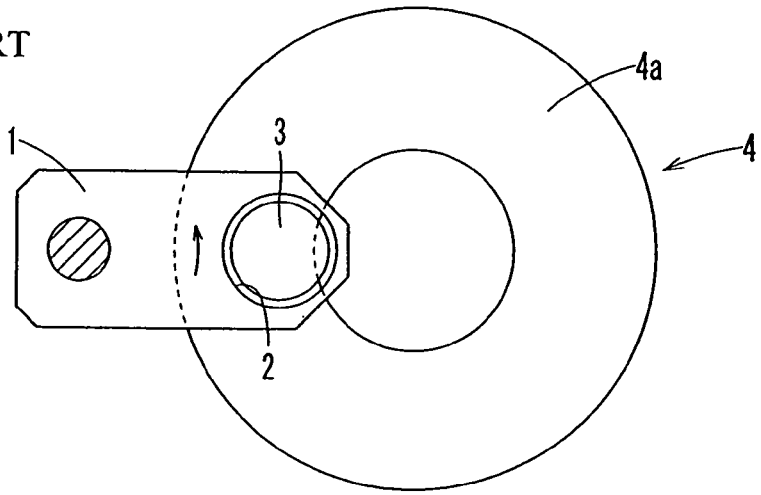
Fig. 11 RELATED ART
FIGS. 11(A) and (B) are explanatory views of a conventional two-sided grinding machine.
Figure 11:
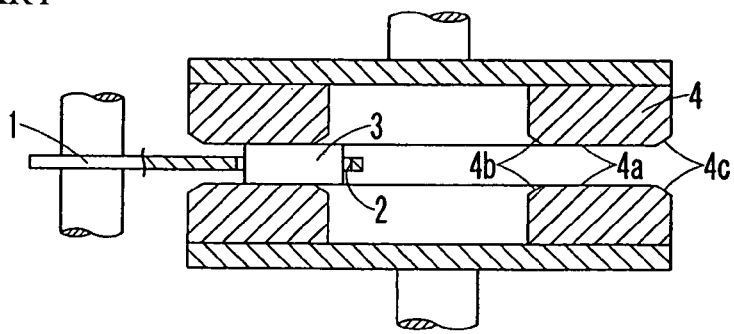
Fig. 11 RELATED ART

FIG. 10 shows by way of example a fifth embodiment of the invention. This embodiment adopts a rotational carrier type of carrier 15, with a circular workpiece 17 mounted in the pocket 14 disposed on the free end side. And it is arranged that the surfaces to be ground 17*a* of the workpiece 17 pass along the inner and outer peripheries of the grinding wheel surfaces 12*a* and 13*a* of the grinding wheels 12 and 13 during the through-grinding. Thus, the workpiece 17 may be of circular or other shape. In addition, this applies also to the linear carrier type.

Each embodiment of the invention has been described in detail so far, but various changed may be made within the range not departing from the gist of the invention. For example, the workpiece 17 may be of elongated form as shown by way of example in the first through fourth embodiment, or it may be of circular form shown by way of example in the embodiment in FIG. 5, or may be of other form.

The carrier 15 is not limited to the linear carrier type in which it makes linear motion or to the rotational carrier type in which it makes rotational motion, but may be of a type adopting other motion type. Further, the construction, shape, etc. of the carrier 15 and pocket 14 may be suitably changed according to the workpiece 17.

Further, the carrier 15 may have a plurality of pockets 14, each holding the workpiece 17. In that case, it is desirable that the pockets 14 be disposed so that each workpiece 17 may pass along the inner and outer peripheries of the grinding wheel surfaces 12*a* and 13*a* of the grinding wheels 12 and 13.

Further, the supply and take-out of the workpiece 17 are effected at the same position in the case of the third and fourth embodiments; however, they may be effected at different positions. Each embodiment shows by way of example a vertical, two-sided surface grinding machine which occupies a small installation floor space, but the invention may be likewise embodied in a horizontal, two-sided surface grinding machine.

What is claimed is:

1. A two-sided surface grinding method comprising infeed grinding which comprises oscillating a workpiece at an infeed grinding position within a range where opposite surfaces of said workpiece do not protrude from inner and outer peripheries of grinding wheel surfaces of a pair of oppositely disposed, rotating grinding wheels, while surface-grinding opposite surfaces of said workpiece simultaneously by the pair of grinding wheels; and then through-grinding comprising feeding said workpiece to allow said surfaces to be ground to pass along inner and outer peripheries of said grinding wheel surfaces, while surface-grinding opposite surfaces of the workpiece simultaneously by the pair of grinding wheels.

2. A two-sided surface grinding method as set forth in claim 1, wherein said infeed grinding further comprises cuttingly driving at least one of said two grinding wheels at a predetermined cutting speed during said oscillating of the workpiece at said infeed grinding position and said through-grinding further comprises effecting sparkout at a forward end of travel of said grinding wheels.

3. A two-sided surface grinding method as set forth in claim 1 or 2, wherein the infeed grinding position is opposite to a discharge side with respect to the center of said grinding wheels and said workpiece is fed from said infeed grinding position to said discharge side.

4. A two-sided surface grinding method as set forth in claim 1 or 2, wherein during said through-grinding, the surfaces to be ground of said workpiece pass along diametrically opposite inner peripheries of said grinding wheels.

* * * * *